US005568690A

United States Patent [19]

Kayama

[11] Patent Number: 5,568,690

[45] Date of Patent: Oct. 29, 1996

[54] DRAFTING INSTRUMENT

[75] Inventor: Hiroshi Kayama, Yokohama, Japan

[73] Assignee: Yugen Kaisha Frontier Engineering, Kanagawa-ken, Japan

[21] Appl. No.: 368,883

[22] Filed: Jan. 5, 1995

[30] Foreign Application Priority Data

Dec. 6, 1994 [JP] Japan ..... 6-302276

[51] Int. Cl.[6] ..... B43L 13/00

[52] U.S. Cl. ..... 33/565; 33/562

[58] Field of Search ..... 33/562, 563, 565

[56] References Cited

U.S. PATENT DOCUMENTS

| | | | |
|---|---|---|---|
| 2,702,944 | 3/1955 | Lane et al. | 33/563 |
| 3,483,628 | 12/1969 | Newman | 33/565 |
| 4,026,030 | 5/1977 | Kuever et al. | 33/565 |
| 4,094,071 | 6/1978 | Denaro | 33/562 |
| 5,099,582 | 3/1992 | Chang | 33/565 |

FOREIGN PATENT DOCUMENTS

| | | | |
|---|---|---|---|
| 444443 | 5/1927 | Germany | 33/565 |
| 883508 | 7/1949 | Germany | 33/565 |
| 3637081 | 2/1988 | Germany | 33/562 |

*Primary Examiner*—Thomas B. Will

*Attorney, Agent, or Firm*—Elliot M. Olstein; Raymond J. Lillie

[57] ABSTRACT

An improved drafting instrument is provided and consists of a base board and a slide member. The instrument is so constructed that various geometrical figures, such as squares, rectangles, right-angled isosceles triangles and regular triangles, are accurately drafted in the various dimensions between a minimum and maximum dimension without using conventional frame rules. The base board is provided with one or more openings, and guide rails along which the slide member is slid and positioned for drawing. By displacing the slide member along one of the guide rails and positioning against the guide rail, a figure having a desired dimension is formed and drafted.

1 Claim, 13 Drawing Sheets

DRAFTING INSTRUMENT

BACKGROUND OF THE INVENTION

1. Field of the Invention

The present invention relates to a drafting instrument, and more particularly to a drafting instrument capable of drafting various sizes of geometrical figures including squares, rectangles and triangles or the like.

2. Brief Description of the Prior Art

Conventionally, there have been various forms of frame-shaped rules (hereinafter, referred to "frame rules") each provided with an opening of a definite size for drafting a square, triangle or the like geometrical figures.

However, in the case of using the conventional frame rules, it is impossible to draft a figure having a desired dimension.

For example, in drafting a rectangular figure, which is most frequently drafted, normally a set of triangular rules are employed, where a necessary dimension of the figure is in advance determined through measurement, and thereafter the actual drawing of the figure is performed based on the obtained dimension. Accordingly, the process is complicated, time consuming and troublesome.

A right-angled isosceles triangle, by using a frame rule having a square opening, can be drafted utilizing adjacent sides of the rule. However, the commercially sold frame rule having no scale of dimension, there is still a disadvantage that, for drawing two sides having an equal length, each of the sides must be separately measured to draft the figure.

Further, although a conventional drafting machine in combination with a right-angled triangular rule may be also used, it is impossible to accurately draft a square or a regular triangle owing to increased number of processes or irregularity of measured positions.

The present invention is made to overcome the disadvantages of the prior art devices.

SUMMARY OF THE INVENTION

An object of the present invention is to provide an improved drafting instrument capable of drafting a geometrical figure having various and desired dimension with a simplified construction of the instrument.

Another object of the present invention is to provide an improved drafting instrument capable of drafting any of the figure including a square, rectangle, right-angled isosceles triangle and regular triangle.

To accomplish the above objects, the drafting instrument of the invention comprises a base board provided with at least one opening formed as a geometrical figure therein; one or more guide rails mounted on the surface of the base board; and a slide member placed on the surface of the base board; whereby the slide member is moved to slide along either one of the guide members with a straight edge thereof to draft the figure having a desired dimension in accordance with the extent of opening which is varied by successively moving the slide member along the guide rail.

The present invention also provides a drafting instrument in which at least one opening include a square opening and a triangular opening formed in the base board.

The present invention also provides a simplified form of a drafting instrument in which one square opening is formed in the base board.

The present invention provides another simplified form of a drafting instrument in which one regular triangular opening is formed in the base board.

The present invention further provides a drafting instrument in which there are provided a first guide rail mounted on the base board so as to be inclined at an angle of 45 degrees with respect to a peripheral edge of the base board; and a second guide rail mounted on the base board in parallel to the first guide rail.

A further embodiment of the present invention provides a drafting instrument in which a retainer member which is inserted by a leg of the joint member; and another retainer member which is inserted by another leg of the joint member.

Figure 2:
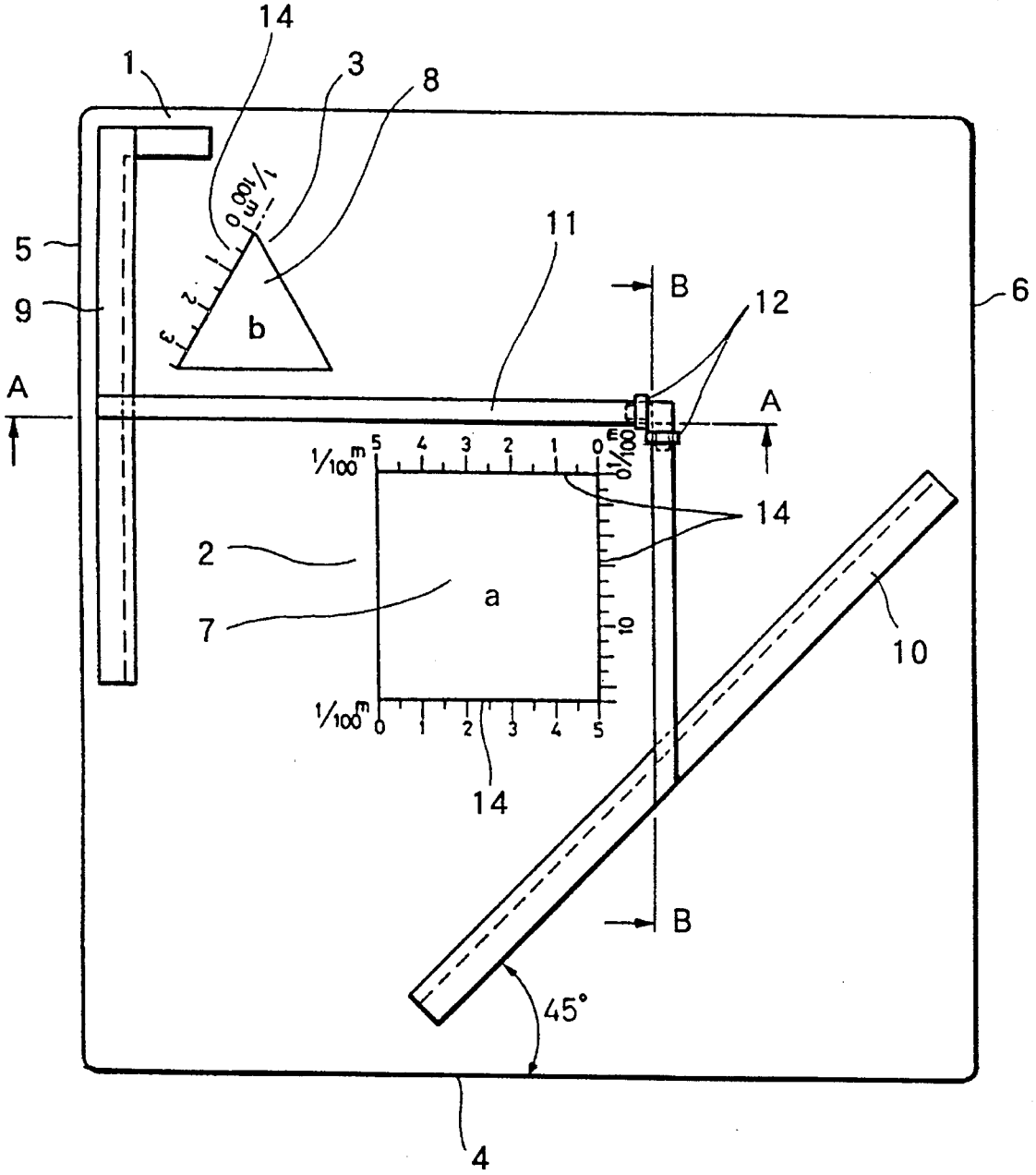
FIG. 2 is a plan view of a base board.
Figure 5:
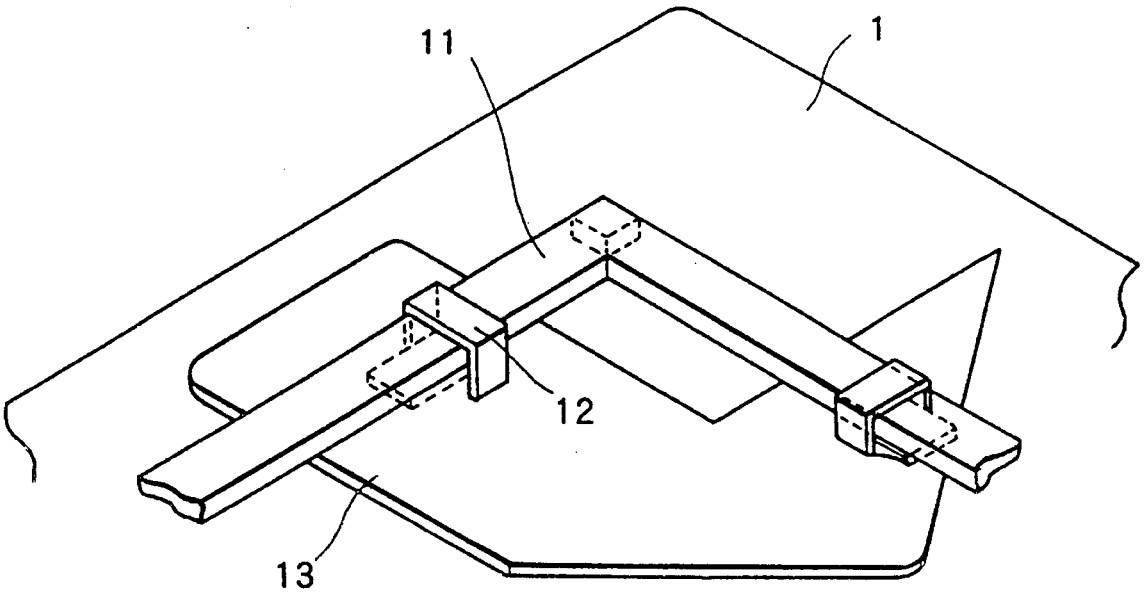
Figure 6:
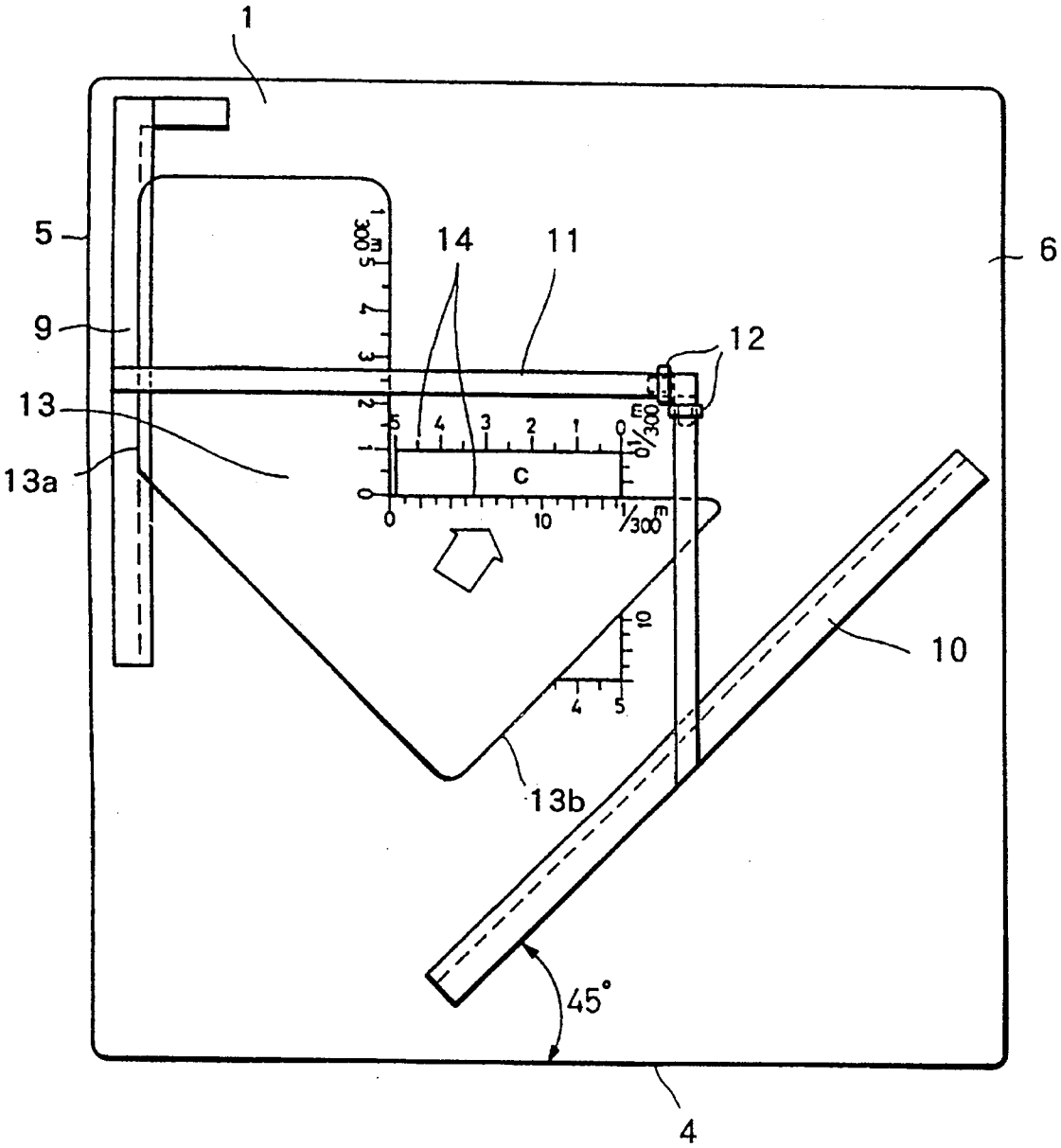
Figure 7:
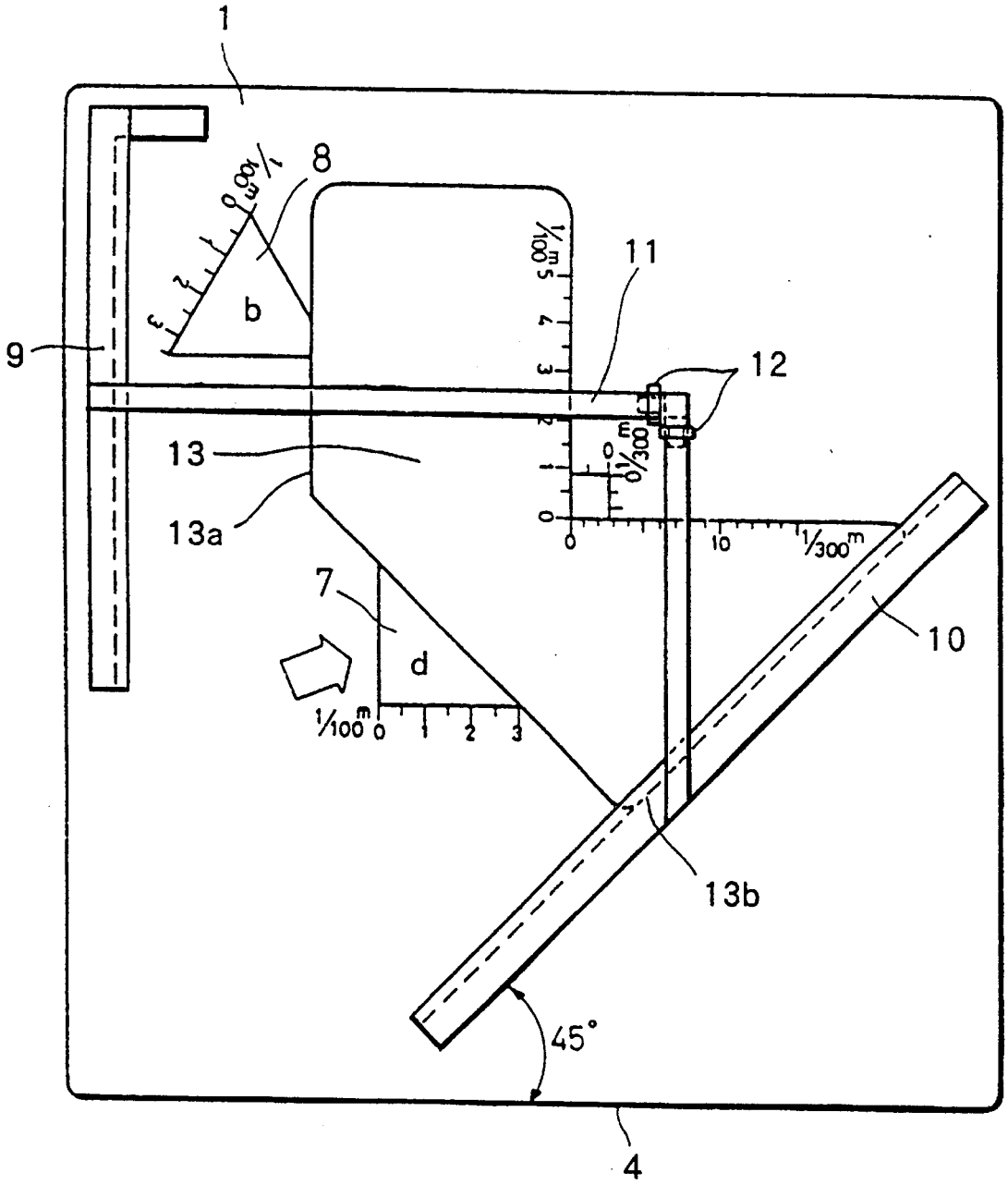
Figure 8:
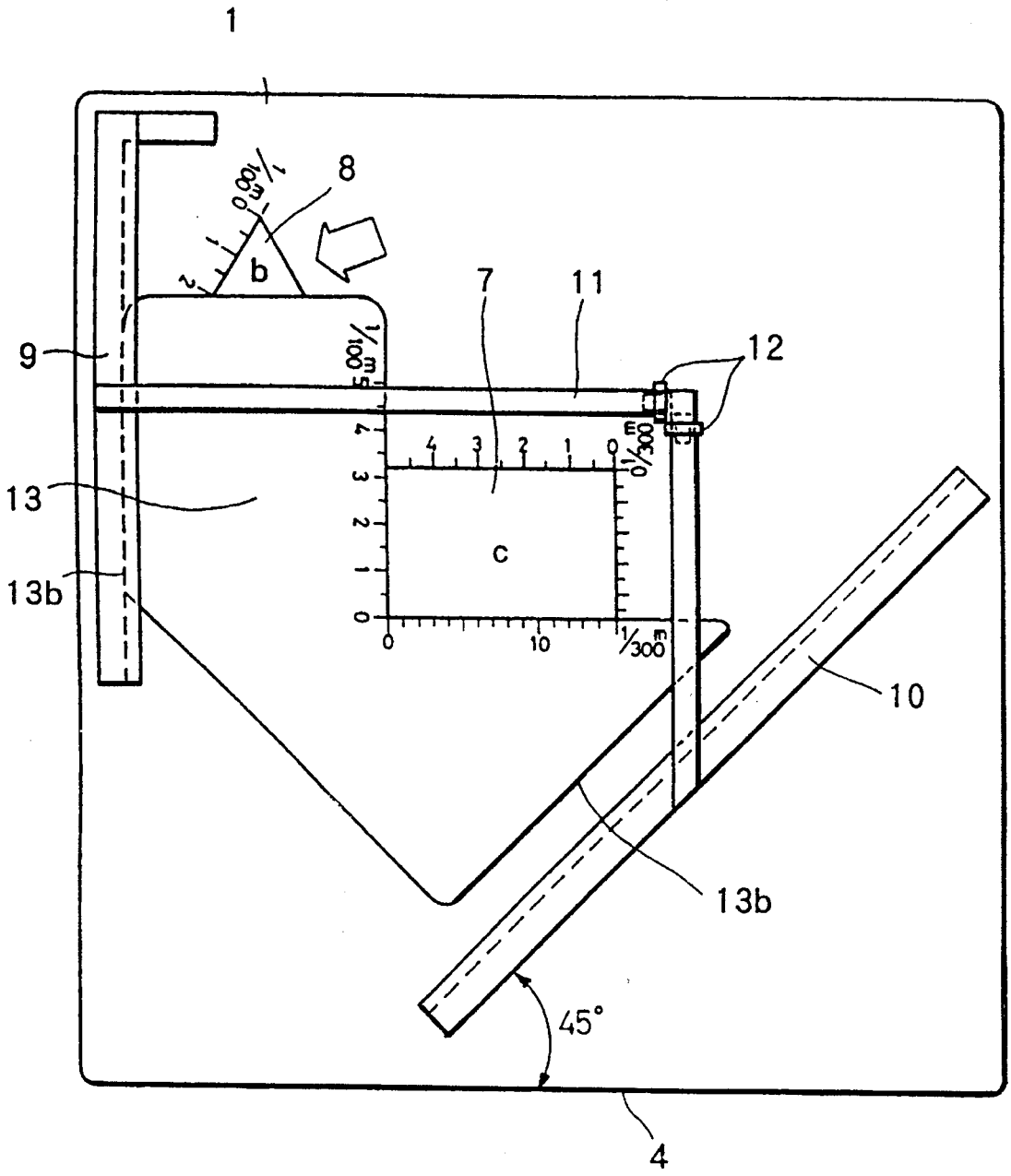
Figure 9:
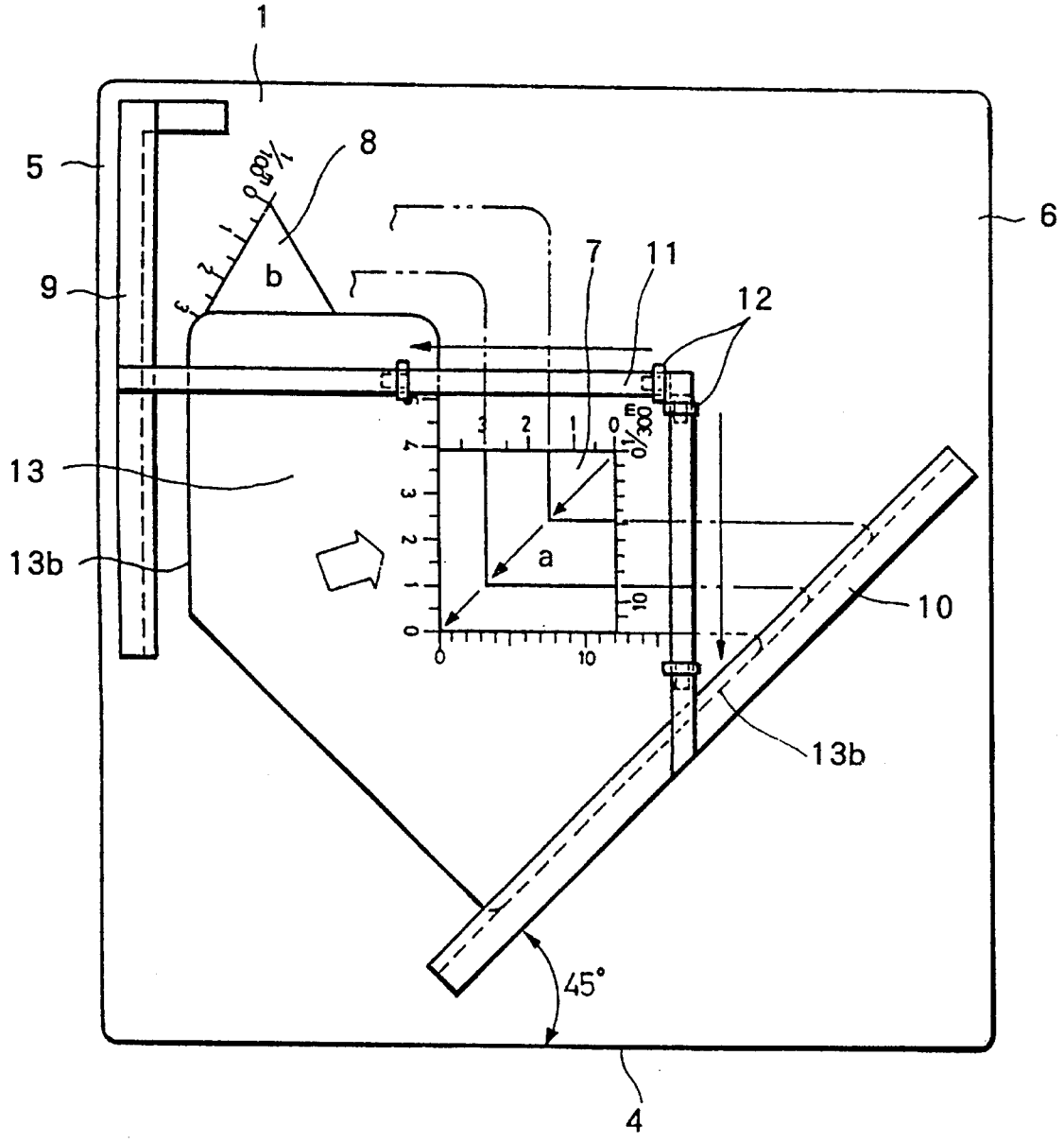
Figure 10:
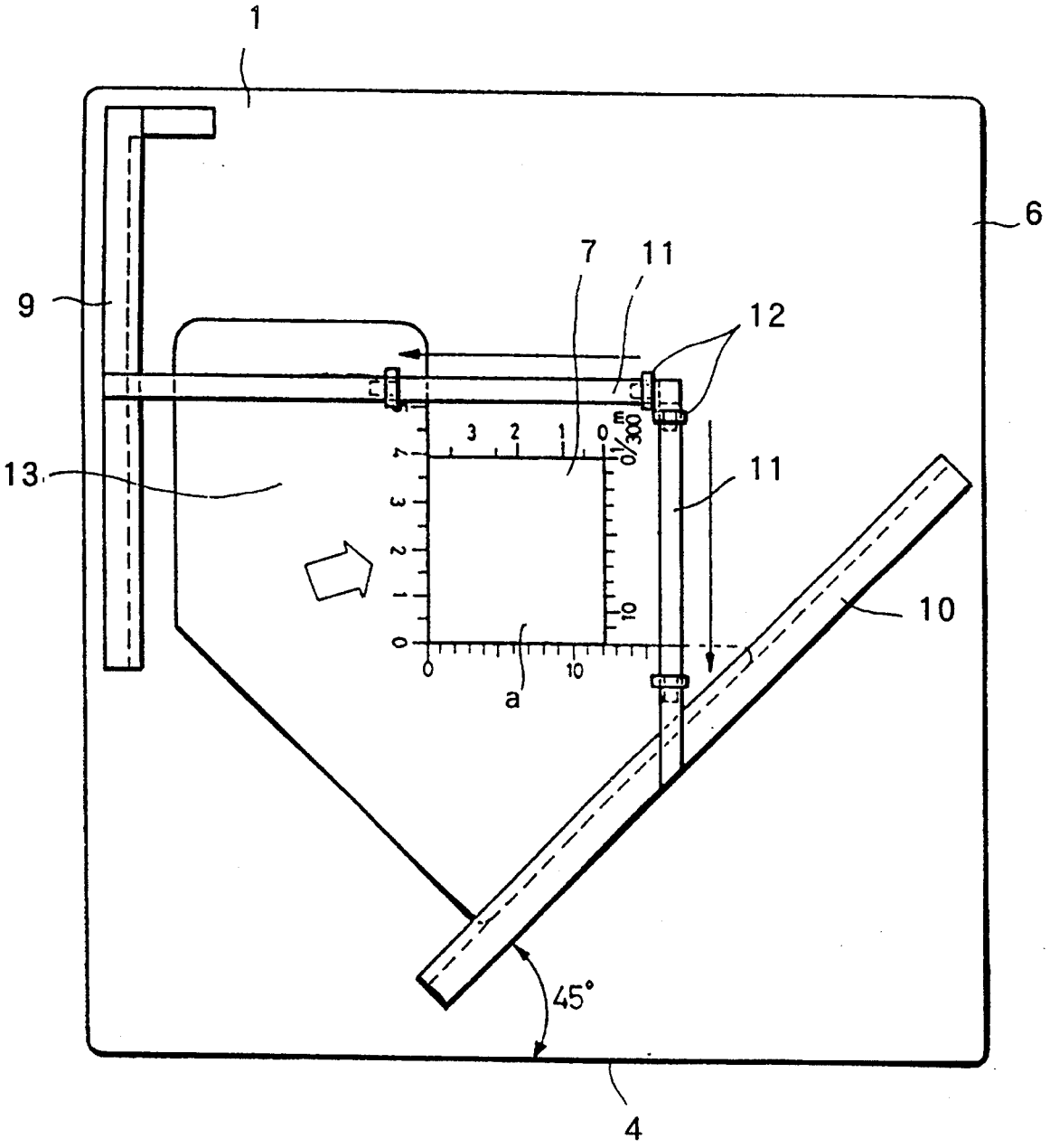
Figure 11:
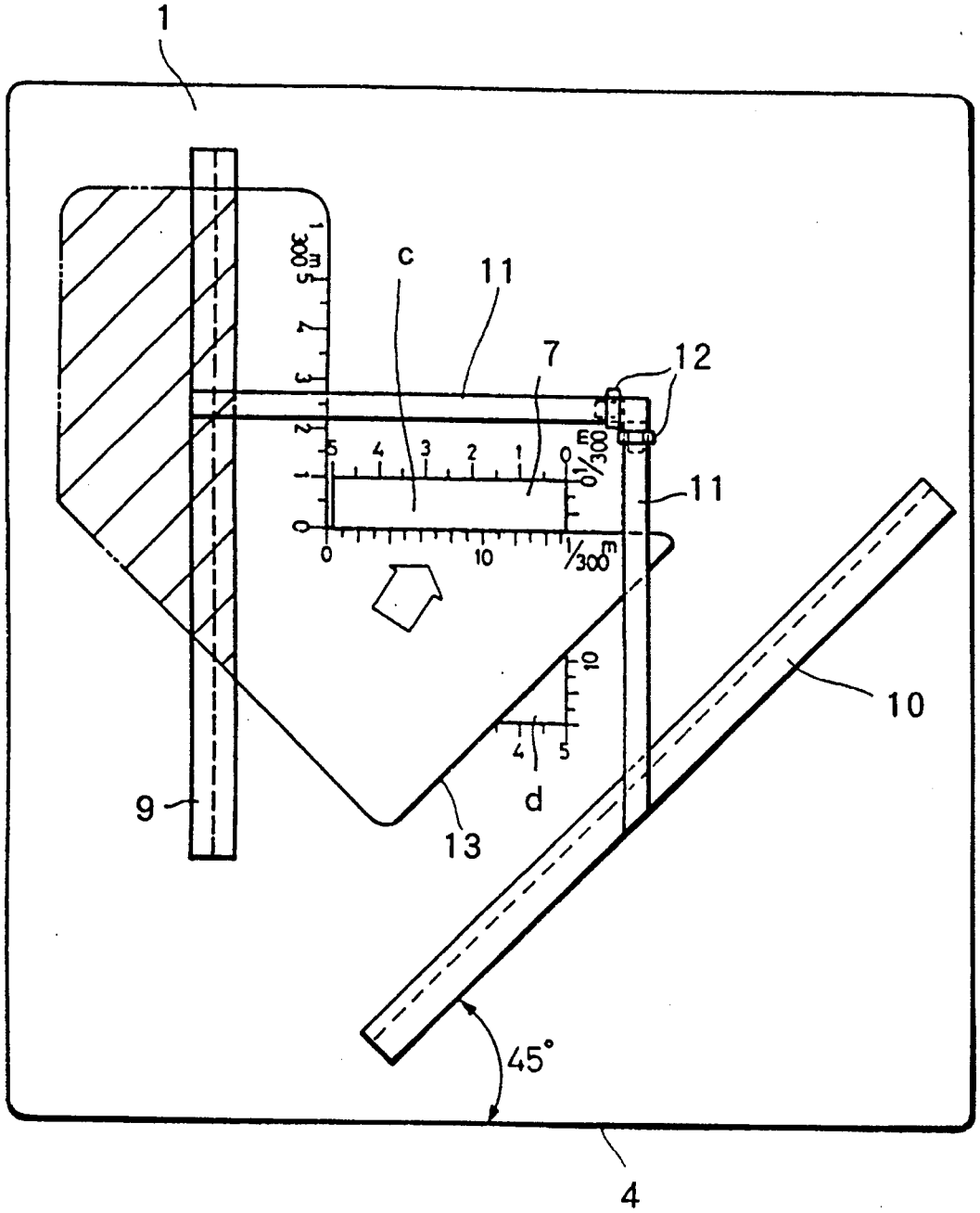
Figure 12:
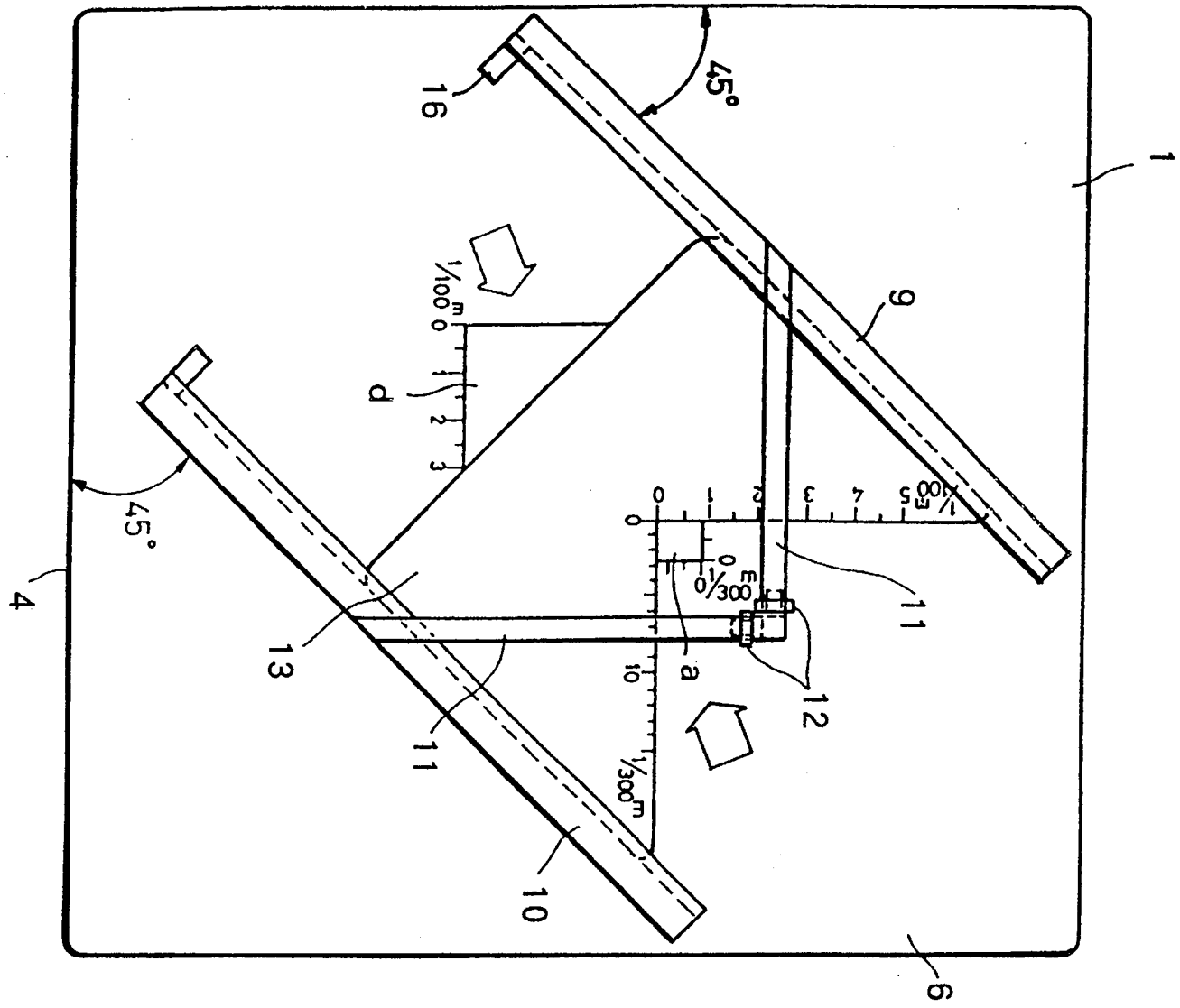
Figure 13:
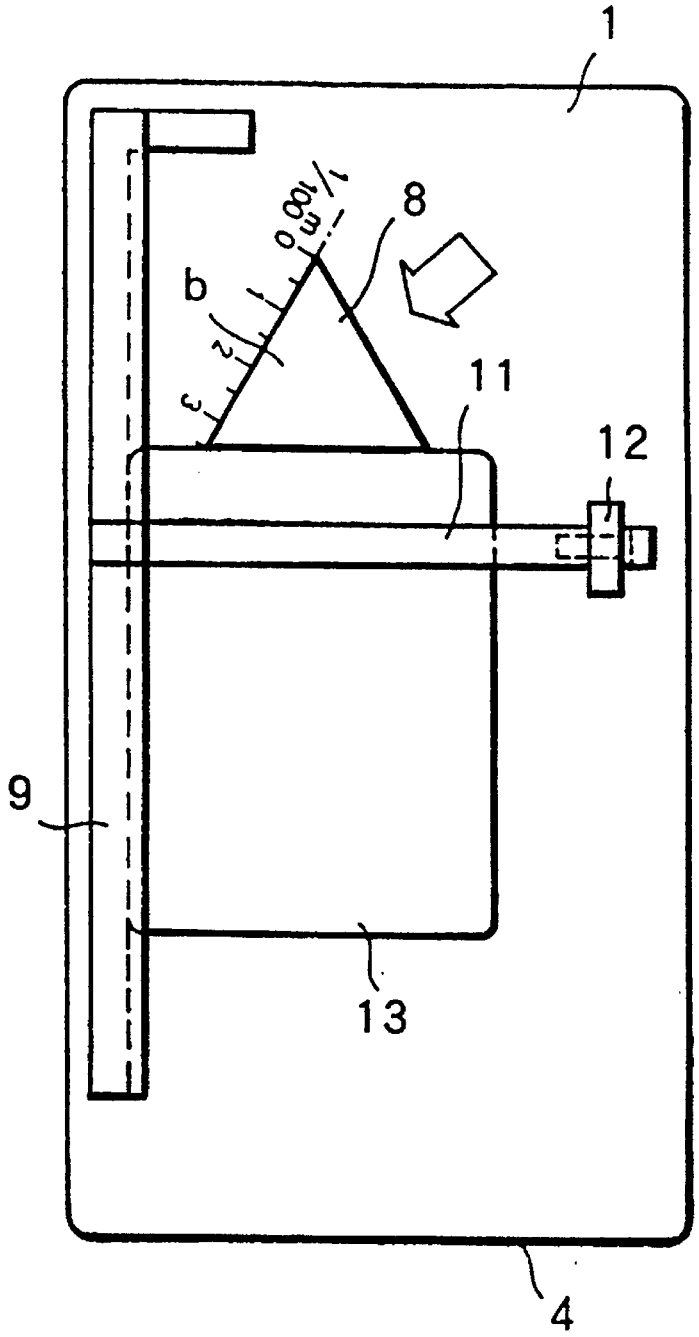

(b) is a sectional view taken along A—A of FIG. 2 of the retainer member moved to retain the slide member;

(c) is a sectional view taken along B—B of FIG. 2 of the retainer member released from the slide member;

(d) is a sectional view taken along B—B of FIG. 2 of the retainer member moved to retain the slide member;

FIG. 5 is a perspective view of a retainer member inserted by a joint member;

FIG. 6 is a plan view of drafting a rectangular figure;

FIG. 7 is a plan view of drafting a right-angled isosceles triangular figure;

FIG. 8 is a plan view of drafting a regular triangular figure;

FIG. 9 is a plan view of drafting a square figure;

FIG. 10 is a plan view of another embodiment having a square opening formed in the base board;

FIG. 11 is a plan view of further embodiment having a square opening;

FIG. 12 is a plan view of a still another embodiment having a square opening; and FIG. 13 is a plan view of a still further embodiment having a regular triangular opening in the base board.

DETAILED DESCRIPTION OF THE PREFERRED EMBODIMENTS

Figure 1:
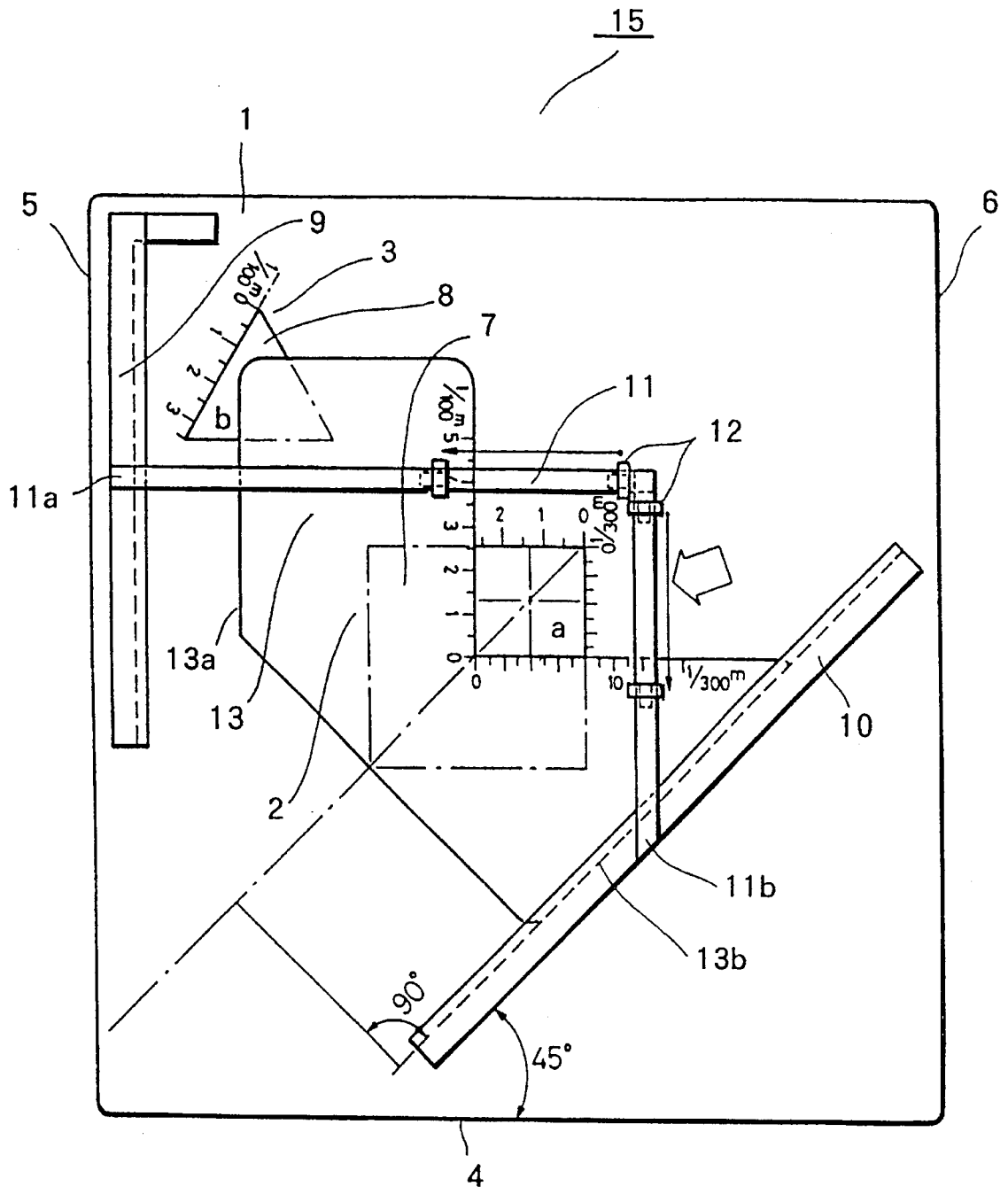
FIG. 1 is a plan view of a drafting instrument according to the present invention.

Referring now to FIG. 1, a plan view of an embodiment of a drafting instrument 15 of the present invention is shown.

Figure 3:
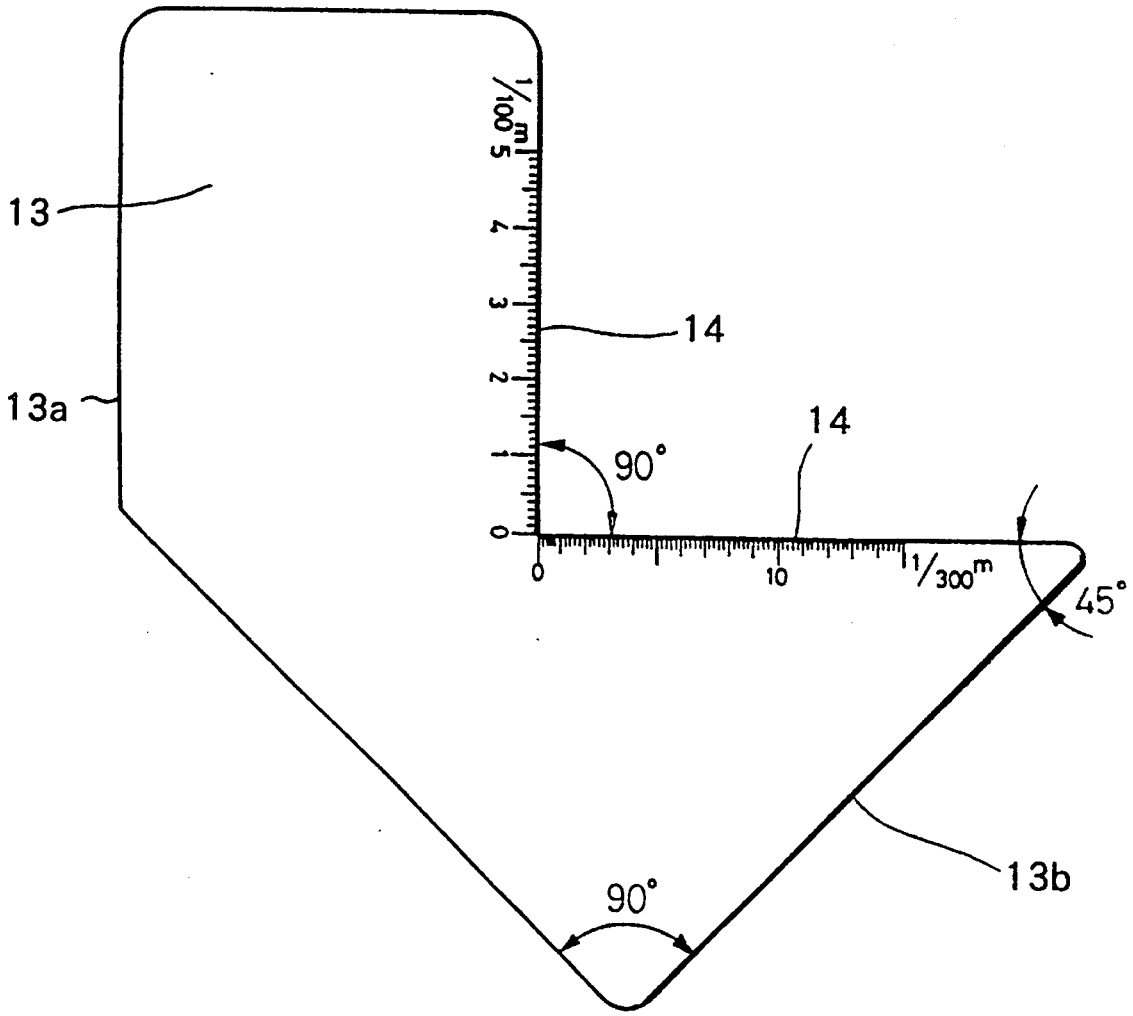
FIG. 3 is a plan view of a slide member.
Figure 4A:
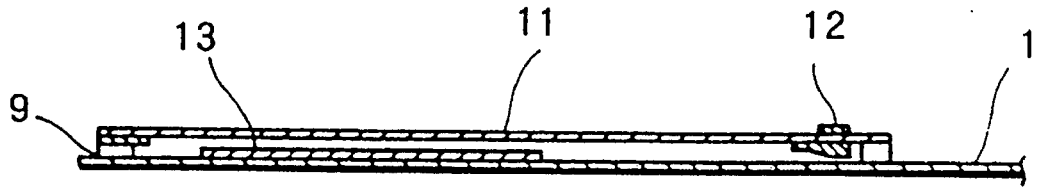
FIG. 4 are illustrative views of a joint member with a retainer member 12, wherein (a) is a sectional view taken along A—A of FIG. 2 of the retainer member released from the slide member.
Figure 4B:
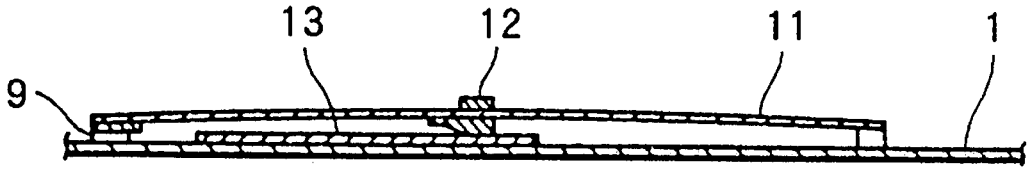
Figure 4C:
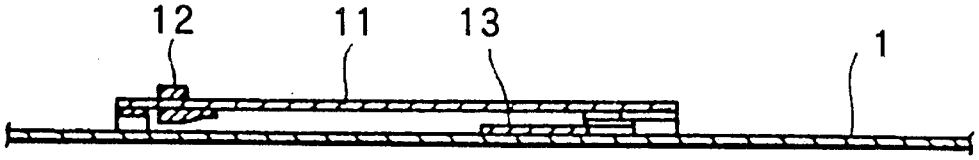
Figure 4D:
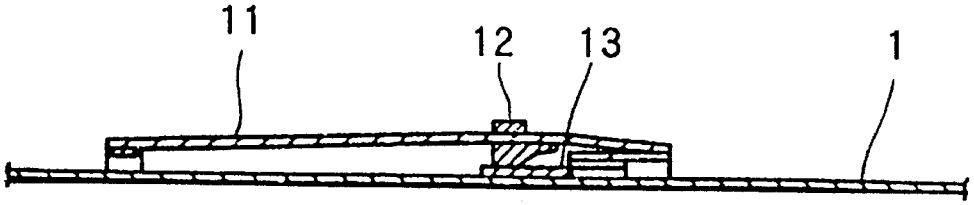

FIG. 2 and 3 illustrate a base board and a slide member, respectively. FIG. 4(*a*) to (*d*), each illustrates a joint member: in (a) and (b), a retainer member is illustrated as sectional views taken along A—A of FIG. 2 as being released from and clamped to the slide member, respectively: and, in (c) and (d), a retainer member is illustrated as sectional views taken along B—B of FIG. 2 as being released from and clamped to the slide member, respectively.

In the drawings, a base board 1 is formed of a rectangularly shaped plastic material, and drafting of a square figure is illustrated. The base board includes a central area 2, a left side top area 3, a bottom side 4 and the left and right sides 5 and 6. A square opening 7 and a regular triangular opening 8 are formed in the central and left side areas, respectively.

A first guide rail 9 is mounted on the left side of base board 1, and a second guide rail 10 is mounted on the board 1 at an angle of 45 degrees relative to the bottom side 4 and right side 6. An L-shaped joint member 11 formed of an elastic material is connected between the guide rails 9 and 10. The L-shaped end portions 11*a* and 11*b* thereof are secured to the guide rails 9 and 10 respectively. A retainer member 12 is provided on each leg of the joint member 11. A slide member 13 can be retained by elastic connection of board 1 and joint member 11. In this embodiment, the slide member 13 has a cut-out area including adjacent edges perpendicular to each other. Edges 13*a* and 13*b* of the slide member 13 are guided by the guide rails 9 and 10, respectively. Scale 14 is graduated on each of the edges of the square opening 7 and triangular opening 8 of the board 1, and also on each edge of the right-angled cutout area of the slide member 13.

In drafting, a sheet of paper (not shown) is placed on the base board 1, either the edge 13*a* or 13*b* of slide member 13 is guided along the guide rail 9 or 10, thereby the square opening 7 or triangular opening 8 is partially shaded to vary the size of the opening to obtain a geometrical figure having a desired dimension.

As shown in FIG. 6, the opening 7 is partially shaded by an edge of slide member 13 to form a rectangular space c which is gradually enlarged by sliding the slide member 13 with its left side edge 13*a* along the first guide rail. The slide member 13 is positioned against the rail to form a rectangle in accordance with the opened area of the opening 7.

As shown in FIG. 7, a right-angled isosceles triangular space d is formed by sliding the slide member 13 with its right side inclined edge 13*b* along the inclined second guide rail 10, the space being gradually varied by moving the slide member 13.

As shown in FIG. 8, the slide member 13 with its edge 13*a* is slidably guided along the first guide rail 9 in the downward direction, thereby the triangular opening 8 is gradually increased to form a triangular figure b having a desired dimension.

Also, as shown in FIG. 9, a square space a having a desired dimension is formed by sliding the slide member 13 with its edge 13*b* along the second guide rail 10 to partially shade the square opening 7.

As an embodiment of the invention, the drafting instrument includes a base board 1 having a central square opening 7 and a regular triangular opening 8 in the left upper area, a first guide rail 9 in the left side area, a second guide rail 10 inclined at 45 degrees, a resilient joint member 11, and a slide member 13. Further including a retainer member 12, by displacing the slide member 13 along the first or second guide rail to partially shade the opening 7 or 8, it is possible to readily and easily form a figure of square a, rectangular c, right-angled isosceles triangular d or regular triangular b having a desired dimension.

FIG. 10 to 12 shows an embodiment in which the base board 1 has only one square opening 7. FIG. 10 is a plan view of the embodiment only different from that in FIG. 1 in that only a square opening 7 is provided.

FIG. 11 shows another embodiment in which a slide member 13 is small-sized as formed in sliced from and removed at the shaded portion of the full sized member of FIG. 3. Rather, the sliding area of the slide member 13 is formed longer to be smoothly guided by the first guide rail 9 to form a rectangle c and a right-angled triangle d.

In the embodiment shown by FIG. 12, the first and second guide rails 9 and 10 in parallel to each other are mounted to be inclined at 45 degrees against the bottom side of base board 1, and a stopper 16 is provided at each end of first and second guide rails 9 and 10 to form various sizes of squares a and triangles d with a simplified construction.

FIG. 13 shows an instrument having a further simplified construction, comprising a base board 1 having only one opening of a regular triangular form, a first guide rail 9, a joint member 11 and a retainer member 12. By sliding the slide member 13 along the guide rail 9, a triangle h having a desired size is formed.

As stated above, by providing a single opening of either square 7 or regular triangle 8, a simplified, small-sized and light weight construction of the drafting instrument is achieved.

What is claimed is:

1. A drafting instrument comprising:

a base board having a central area, an upper left area, a left side, and a right side, said base board having a square opening in said central area and said base board having a regular triangular opening in the upper left area;

a first guide rail mounted adjacent the left side of said base board;

a second guide rail mounted at an incline of 45 degrees with respect to the right side of said base board;

a joint member formed of two legs extending in right-angled direction with each other for connecting said first and second guide rails;

first and second retainer members respectively attached to each leg of said joint member; and a slide member placed on said base board, and retained and released by means of said retainer members, whereby said slide member is capable of being positioned over one of said square opening and said regular triangular opening to obtain a geometrical figure having a desired dimension.

* * * * *